United States Patent [19]

Murai et al.

[11] Patent Number: 4,483,673

[45] Date of Patent: Nov. 20, 1984

[54] CATALYTIC COMBUSTION ARRANGEMENT

[75] Inventors: Eiji Murai, Kashihara; Tomiji Suzuki, Nara; Hiroki Sadamori, Kashihara; Kazuhito Taguchi, Yamatokoriyama, all of Japan

[73] Assignees: Matsushita Electric Industrial Co., Ltd., Kadoma; Osaka Gas Company, Ltd., Osaka, both of Japan

[21] Appl. No.: 472,475

[22] Filed: Mar. 7, 1983

[51] Int. Cl.[3] ..... F23D 13/12

[52] U.S. Cl. ..... 431/328; 431/46; 431/60; 431/80

[58] Field of Search ..... 431/46, 80, 328, 25, 431/59, 60, 50, 52, 55, 329

[56] References Cited

U.S. PATENT DOCUMENTS

| | | | |
|---|---|---|---|
| 2,127,445 | 8/1938 | Hardgrove | 431/46 |
| 2,477,216 | 7/1949 | Strobel | 431/59 |
| 2,862,665 | 12/1958 | Matthews | 431/55 |
| 3,174,535 | 3/1965 | Weber | 431/80 |
| 3,270,798 | 9/1966 | Ruff | 431/329 |
| 3,658,482 | 4/1972 | Evans et al. | 431/80 |
| 4,131,413 | 12/1978 | Ryno | 431/52 |

FOREIGN PATENT DOCUMENTS

| | | | |
|---|---|---|---|
| 2022236 | 12/1979 | United Kingdom | 431/80 |

*Primary Examiner*—Samuel Scott
*Assistant Examiner*—Noah Kamen
*Attorney, Agent, or Firm*—Wenderoth, Lind & Ponack

[57] ABSTRACT

The disclosure is directed to an improved catalytic combustion arrangement for use, for example, in a gas stove or the like, which has a heat insulation diffusion layer is provided in a catalytic mat layer for the improvement of combustion rate around the catalytic mat, and, through employment of two sets of thermo-couples, a heating burner for the catalytic mat is adapted to burn only during starting of combustion, and to be automatically extinguished upon arrival at a steady combustion state for continuous combustion only by the catalytic mat, with a simultaneous indication of such combustion.

3 Claims, 10 Drawing Figures

CATALYTIC COMBUSTION ARRANGEMENT

BACKGROUND OF THE INVENTION

The present invention generally relates to a combustion apparatus and more particularly, to a catalytic combustion arrangement for use in a gas heater and the like or other industrial combustion equipment in general.

In a conventional catalytic burner, it has been the practice, for example as shown in FIG. 1, that a heat-resistant wire netting or wire mesh W, a catalytic mat M supporting a catalyst, a diffusion heat insulation layer DH, and a supporting plate S having through-holes h formed therein, are piled one upon another in that order from above into one unit constituting a catalytic mat layer L which is accommodated in a casing H, with the entire peripheral edge of said heat-resistant wire mesh W being depressed from above by a cover member C for fixing. In the known construction as described above, however, since the catalytic mate M directly contacts a flange portion Ha of the casing H, heat at the contact portion of the mat M is absorbed by the flange portion Ha, with a consequent reduction of combustion rate or combustion and hydrocarbon emission rate (which may be represented by: volume of hydrocarbon discharged from the mat M/total volume of hydrocarbon supplied to a combustion apparatus) during a steady combustion at said portion.

Meanwhile, in a known igniter construction for the catalytic mat M as shown in FIG. 2, upon opening of a cock K, gas is fed through a gas pipe P to the mat M through a gas nozzle N, while simultaneously, a pilot flame burner F is ignited, and thus, the fuel within the mat M is gradually ignited from the portion surrounding the pilot burner F for combustion throughout the mat M as a whole. However, in the conventional arrangement as described above, the combustion rate at the early stage of combustion is extremely low, since the catalytic combustion of the fuel is started from the portion surrounding the preheating burner, and unburnt gas is discharged from other portions which have not reached the temperature of initiation of catalytic combustion.

Alternatively, in another conventional catalytic mat arrangement as shown in FIG. 3, as electric heater element E is embedded within the catalytic mat M, and the heater element E is energized in association with opening of the cock K and is kept energized during combustion, or is de-energized upon arrival at the steady combustion state. In the prior art arrangement as described above, however, an electric circuit including the electric heater element is required in addition to the gas line, and thus, the construction is undesirably complicated, with a consequent rise in cost.

SUMMARY OF THE INVENTION

Accordingly, an essential object of the present invention is to provide an improved catalytic combustion arrangement in which combustion rate has been improved particularly in the early stage of combustion and during steady combustion, with a reduction of $No_x$ generation during such steady combustion in which a pilot burner or the like is not burned and therefore, no flame burner producing $No_x$ is employed.

Another important object of the present invention is to provide a catalytic combustion arrangement of the above described type, which makes it possible to effect the process ranging from initiation to steady state combustion only through operation of a gas cock without employment of any electrical heating means.

A further object of the present invention is to provide a catalytic combustion arrangement of the above described type, which is arranged to automatically cut off the gas in case of mis-fire for improved safety.

Another object of the present invention is to provide a catalytic combustion arrangement of the above described type, which is capable of displaying that combustion is taking place, for preventing dangerous states resulting, for example, from the burner inadvertently not being extinguished. The heating by the preheating burner, which is a preparatory stage before reaching the catalytic combustion is automatically suspended upon arrival at the steady catalytic combustion, with only the catalytic burner burning and no flame burner burning.

In accomplishing these and other objects, according to one peferred embodiment of the present invention, there is provided a catalytic combustion arrangement which includes a catalytic mat layer having a catalytic mat which supports a catalyst, a casing for accommodating the catalytic mat layer therein, means for supplying a fuel into the casing through a safety valve, a preheating burner for preheating the catalytic mat, means for feeding the fuel to the preheating burner through a control valve, a first set of thermo-couples which are disposed close to the catalytic mat with one of the thermo-couples of the first set disposed at a position close to the preheating burner, while the other of the set is positioned in the mat at a position sufficiently spaced from the one so as not to be directly subjected to the heat of the preheating burner, and which are connected in series with each other and coupled with an opening means for said safety value, and a second set of thermo-couples which are also disposed close to the catalytic mat with one of the thermo-couples in said second set disposed adjacent to the preheating burner, and which are connected in series with each other and coupled with an opening means for said control valve. The thermo-couples of the first set are connected to each other to cnacel the thermo-electromotive forces generated in the respective thermo-couples, and the thermo-couples in the second set are connected so as to add the thermo-electromotive forces generated.

By the arrangement according to the present invention as described above, an improved catalytic combustion arrangement has been advantageously provided and which has a simple construction, and with substantial elimination of disadvantages inherent in the conventional arrangements of this kind.

BRIEF DESCRIPTION OF THE DRAWINGS

These and other objects and features of the present invention will become apparent from the following description of a preferred embodiment thereof and with reference to the accompanying drawings, in which.

DETAILED DESCRIPTION OF THE INVENTION

Figure 1:
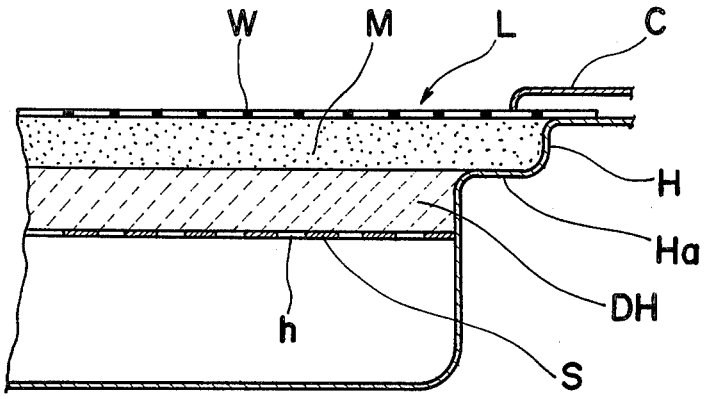
FIG. 1 is a fragmentary side sectional view showing the construction of a catalytic mat layer portion of a conventional catalytic combustion arrangement.
Figure 2:
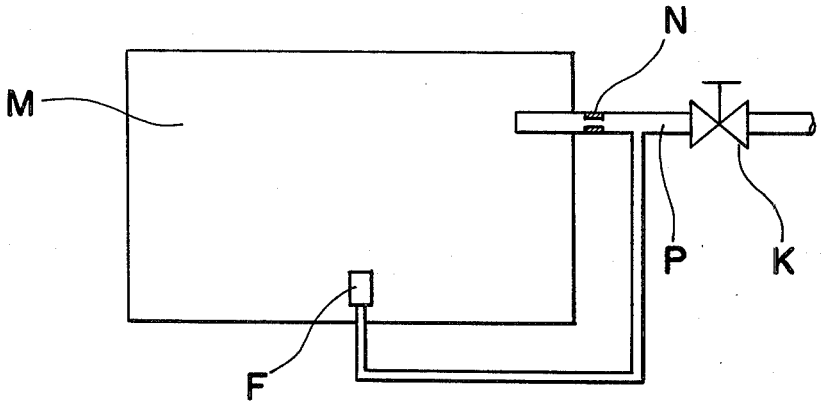
FIGS. 2 and 3 are schematic diagrams explanatory of constructions of conventional catalytic combustion arrangements.
Figure 3:
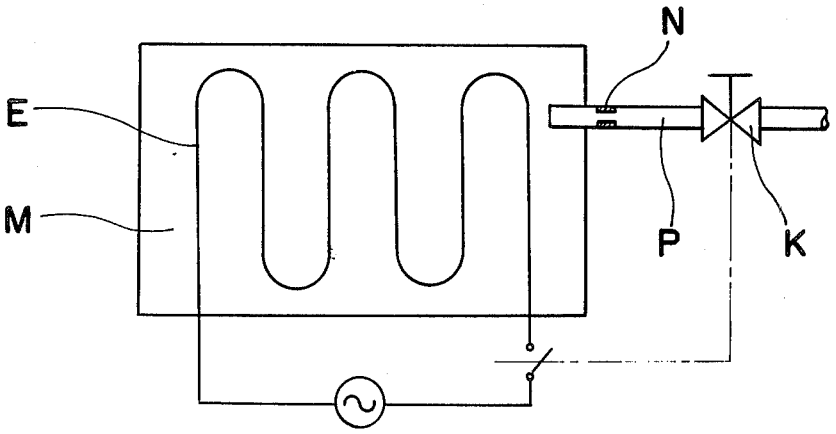

Before the description of the present invention proceeds, it is to be noted that like parts are designated by like reference numerals throughout the accompanying drawings.

Figure 4:
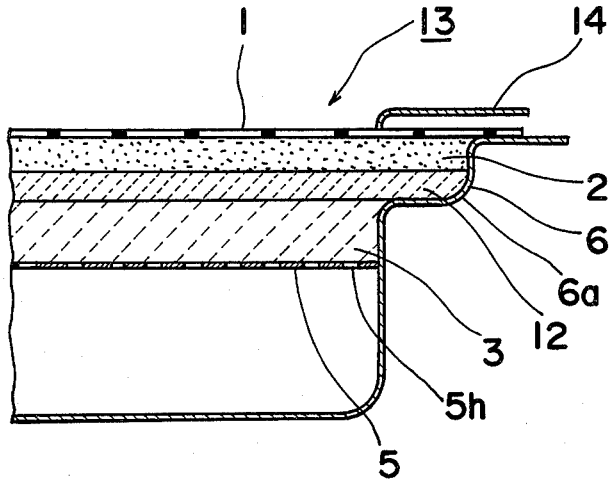
FIG. 4 is a fragmentary side sectional view showing the construction of a catalytic mat layer portion of an improved catalytic combustion arrangement according to the present invention.
Figure 5:
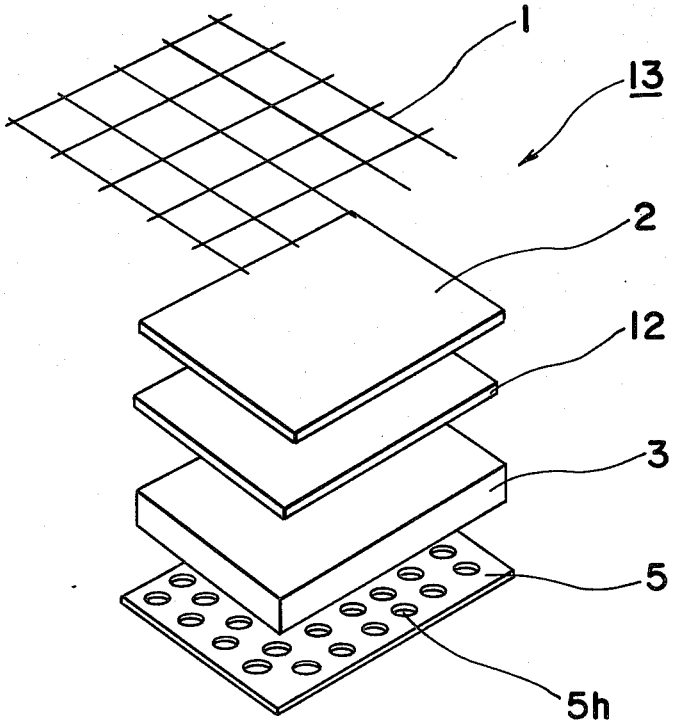
FIG. 5 is a perspective exploded view of the catalytic mat portion of FIG. 4.

Referring now to the drawings, there is shown in FIGS. 4 and 5, the construction of a catalytic mat layer portion employed in a catalytic combustion arrangement (FIG. 6) according to one preferred embodiment of the present invention. In FIGS. 4 and 5, the internal structure of the catalytic mate layer 13 includes a heat-resistant wire mesh 1, a catalytic mat 2 which supports a catalyst (not particularly shown), two kinds of heat insulation layers 3 and 12 having different densities, and a backing or supporting plate 5 having through-holes 5h formed therein, all of which are piled up one upon another in that order from above into one unit, the entire structure of catalytic mat layer 13 thus formed being accommodated in a casing 6, with the heat-resistant wire mesh 1 being fixed by a cover member 14 depressing the whole peripheral edge of said wire mesh 1.

The catalytic mat 2 as described above is constituted by a material having a strong catalytic effect over combustible gases such as platinum, palladium, rhodium or the like, supported on a cotton-like heat-resistant mat having a predetermined thickness and made of, for example, fibers of alumina, silica, and the like, so as to achieve combustion reaction through a catalytic effect by the combustible gas and secondary air on the surface and inner layer of said catalytic mat 2. In the above construction, the combustible fuel passes, from the interior of the casing 6, through the mat layer 13 in the order of the supporting plate 5, the two kinds of heat insulation layers 3 and 12, catalytic mat 2, and heat-resistant wire mesh 1, and is subjected to complete combustion while passing through the catalytic mat 2. Therefore, since activity of the catalyst is reduced due to lowering of the temperature, combustion heat is retained by the diffusion heat insulation layer 3 and heat insulation diffusion layer 12 fior uniform diffusion.

However, owing to the fact that the peripheral portion of the catalytic mat mat 2 contacts the flange portion 6*a*, etc. of the casing 6 and is inevitably more readily cooled than the central portion thereof, such peripheral portion contacting the casing 6 is given an increased density for blocking flow of the combustion fuel, while direct contact of the catalytic mat 2 with such flange portion is avoided as far as possible.

The heat insulation layer 12 with the high density has for its main object to insulate against loss of heat, and has a thickness approximately ½ that of the diffusion heat insulation layer 3, with a density about two times that of said layer 3, while said heat insulation layer 3 is mainly intended for uniform gas diffusion.

As is seen from the foregoing description, in the construction of the catalytic mat layer portion according to the embodiment of the present invention as explained so far, owing to the various layers provided therein, uniform diffusion of combustion fuel is advantageously achieved, without the the catalytic mat 2 being cooled by the casing 6. Moreover, since the contacting portion of the catalytic mat 2 is arranged to be high in density and small in thickness, not only is erroneous work eliminated during assembly, but also, the catalytic mat 2 may be efficiently utilized without being cooled excessively particularly for appliances used during cold winters such as gas heaters and the like.

Figure 6:
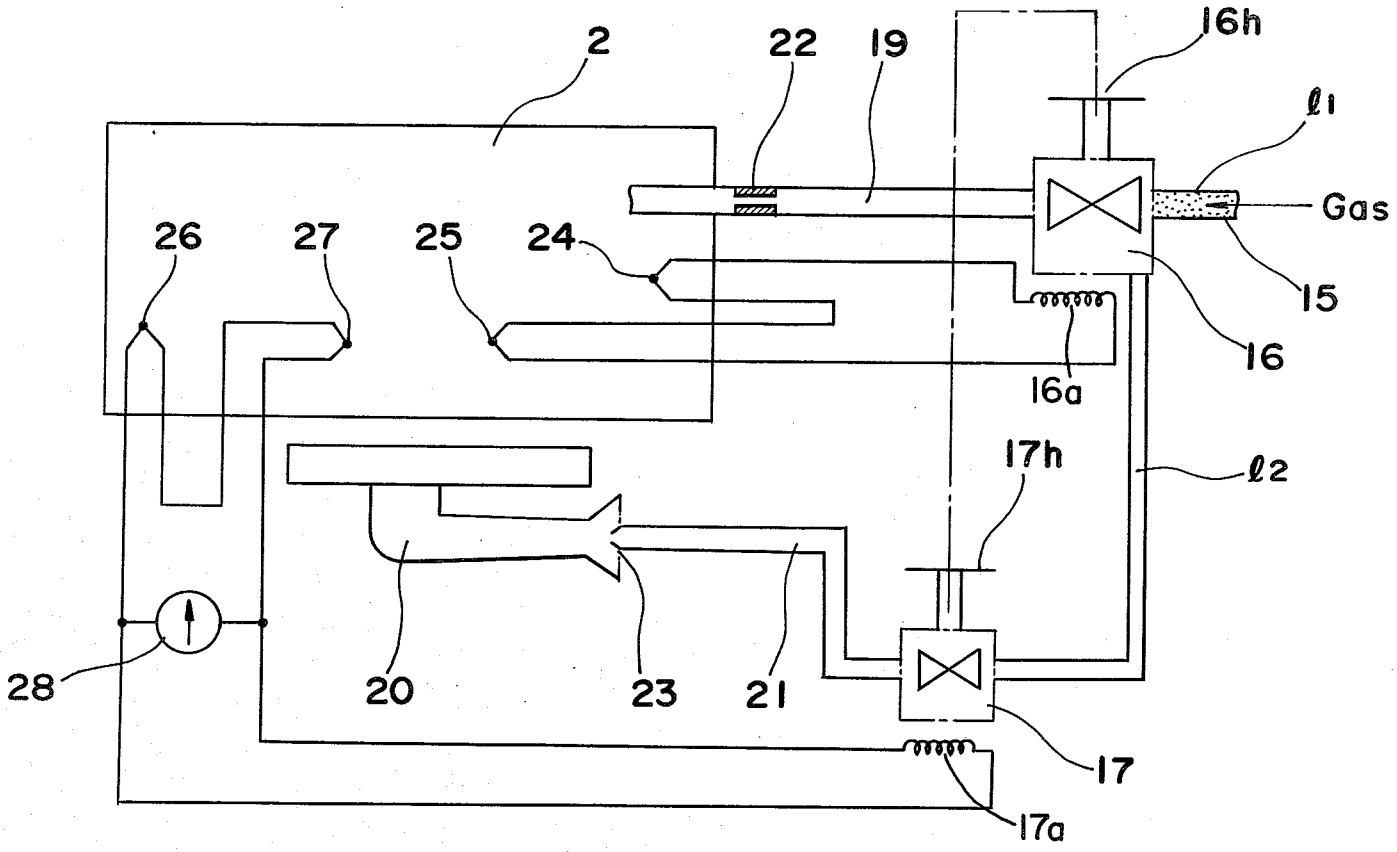
FIG. 6 is a schematic diagram showing the construction of the catalytic combustion arrangement according to one preferred embodiment of the present invention.
Figure 7:
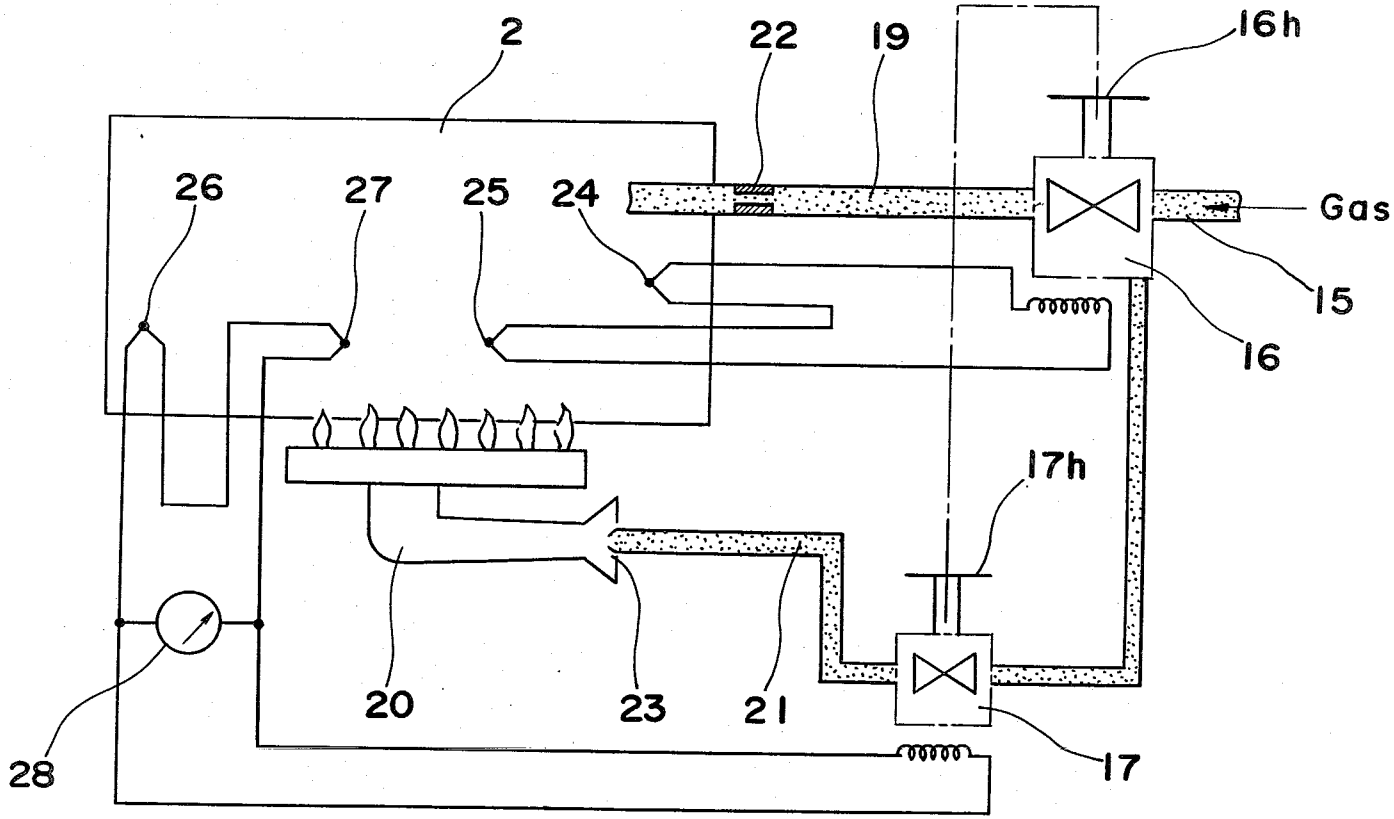
FIGS. 7 and 8 are diagrams similar to FIG. 6, which are particularly explanatory of functionings thereof.
Figure 8:
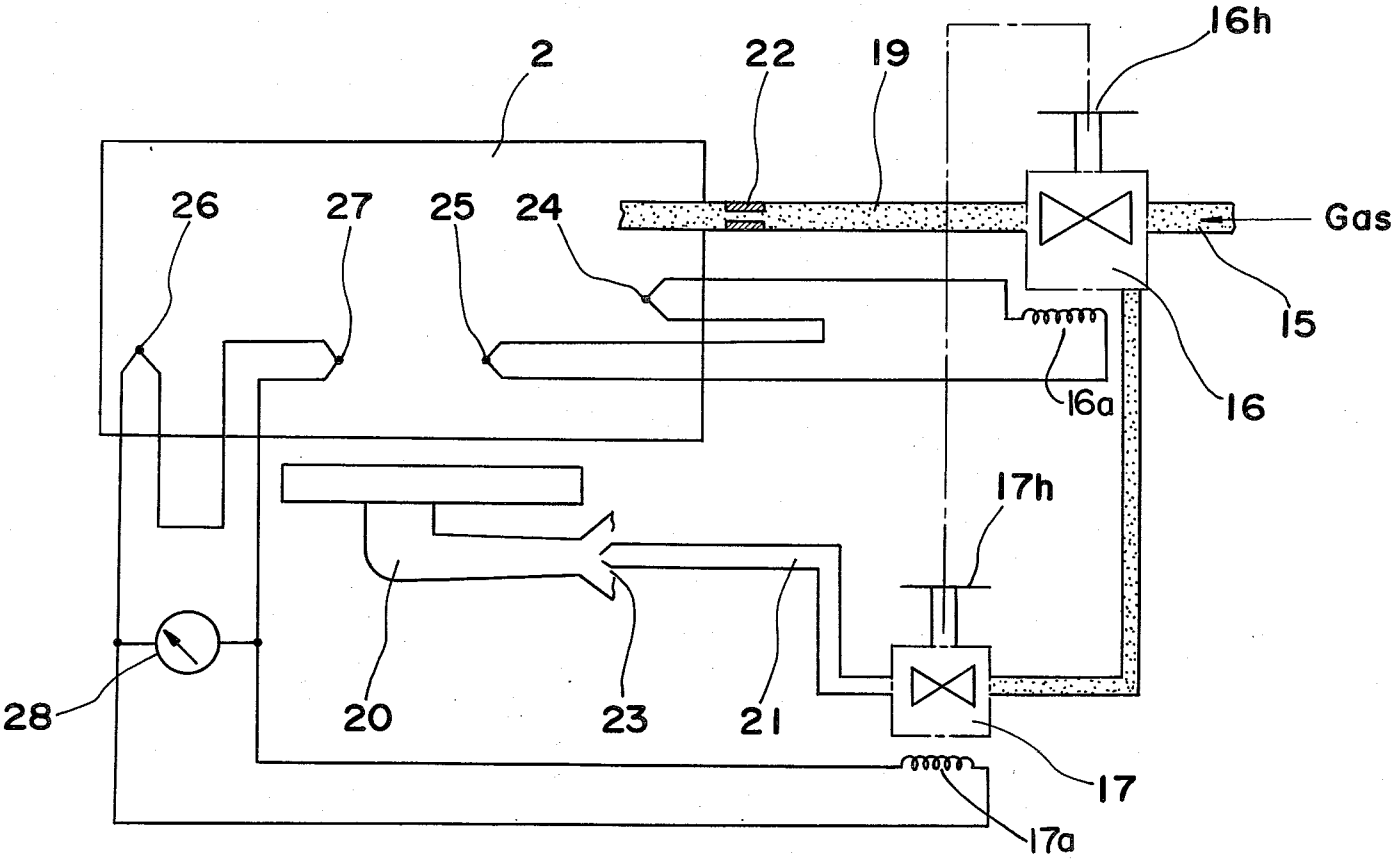

Referring also to FIGS. 6 to 8, a gas line circuit and a gas combustion construction for the catalytic combustion arrangement according to the present invention will be described hereinbelow.

In FIG. 6, the catalytic combustion arrangement of the present invention generally includes a gas line 11 having, at its one end, a gas introduction port 15, and connected, at its other end, to a safety valve 16 having a control knob 16*h* and further connected to a gas passage 19 which is provided with an orifice 22 and led to the catalytic mat 2, another gas line 12 connecting said safety valve 16 to a control valve 17 which has a control knob 17*h* and is further connected to a gas passage 21 reaching a preheating burner 20 through its gas nozzle 23, a set of thermo-couples 24 and 25 connected in series with an electromotive operating coil 16*a* of the safety valve 16 and with thermo-couple 24 disposed close to the edge of catalytic mat 2 and thermo-couple 25 disposed close to the preheating burner 20, another set of thermo-couples 26 and 27 connecgted in series with an electromotive operating coil 17*a* of the control valve 17 and with thermo-couple 26 also disposed adjacent to the edge of the catalytic mat 2, and thermo-couple 27 disposed close to the burner 20, and an indicating meter 28 connected in parallel to the thermo-couples 26 and 27. By operating the knobs 16*h* and 17*h* of the safety valve 16 and the control valve 17, the combustible fuel introduced through the gas introduction port 15 passes through the gas passage 19 for main burner (catalytic) and gas for a pilot burner (not shown), and reaches the catalytic mat 2 through the orifice 22 on one hand, and on the other hand, passes through the gas passage 21 and the gas nozzle 23, into the preheating burner 20, which is necessary for preheating the catalytic at 2 to a temperature higher than its activating temperature at the surface of the catalytic mat 2.

Referring also to FIGS. 7 and 8, functionings of the catalytic combustion arrangement of FIG. 6 will be explained hereinbelow.

In FIG. 6, since the safety valve 16 is in the normally closed state, the combustible fuel is fed only up to said safety valve 16.

Subsequently, as shown in FIG. 7, the combustible fuel is fed into the gas passages 19 and 21 through rotation of the linked knobs 16*h* and 17*h* for the safety valve 16 and control valve 17, while simultaneously, the preheating burner 20 is ignited by an igniting device (not shown) associated with the safety valve 16. Upon heating of the catalytic mat 2 by the preheating burner 20, combustion is started from the portion of the surface of said catalytic mat 2 heated by the preheating burner. At this time, since the thermo-couples 25 and 27 are heated, they produce current, and the operating coils of the normally closed safety valve 16 and the normally closed control valve 17 are driven to maintaining the valves in the opened state by electromotive force-producing current from said thermo-couples as shown by the curves in FIGS. 9 and 10.

Figure 9:
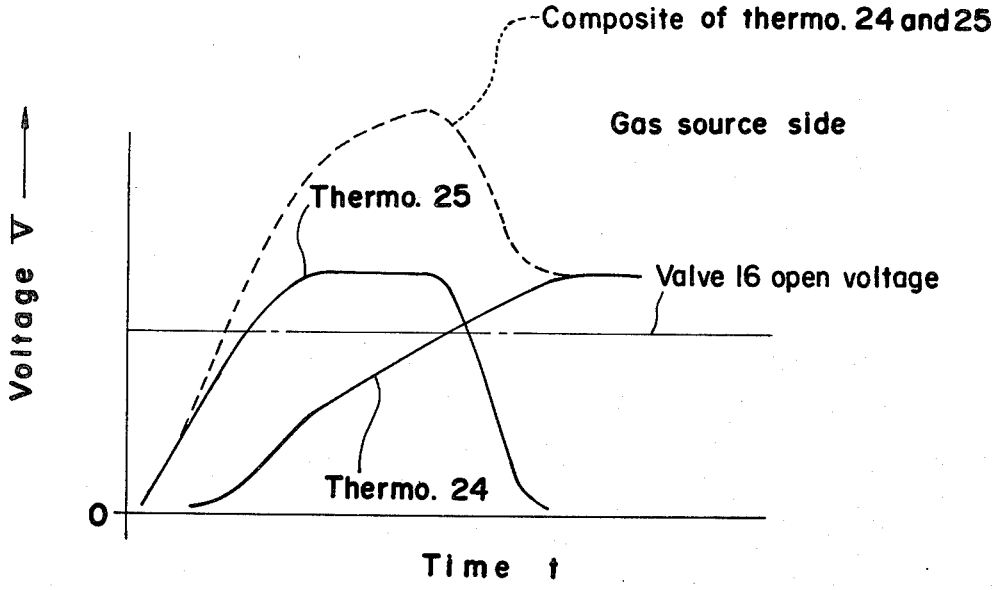
FIGS. 9 and 10 are graphs showing characteristics of the thermo-couples employed in the arrangement of FIG. 6.
Figure 10:
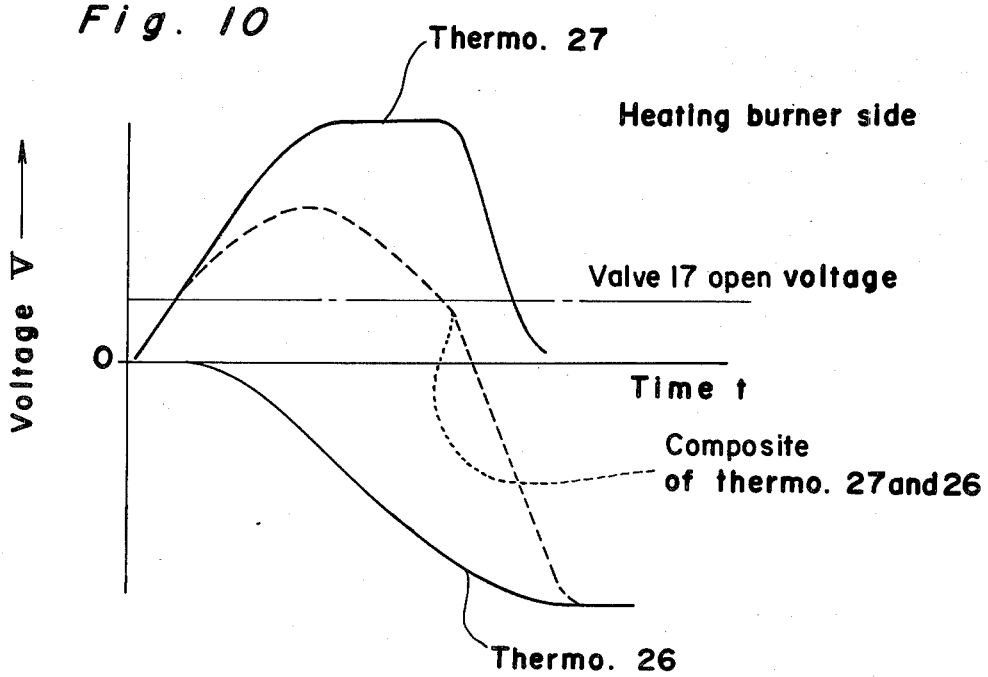

In FIG. 8, although catalytic combustion is started on the catalytic mat 2 activated by the preheating, such combustion has not yet extended over the entire surface thereof, and combustion reaction takes place over the whole surface as time elapses, so the electromotive force-producing currents produced in the thermo-couples 24 and 26 are gradually increased as shown by the curves in FIGS. 9 and 10. Since the thermo-couple 24 is connected in such a direction that the electromotive force producing current thereof is added to that of the thermo-couple 25, while the thermo-couple 26 is connected in a direction to concel the electromotive force-producing current of the thermo-couple 27, the control valve 17 finally reaches the state where the composite of electromotive force-producing currents from thermo-couples 26 and 27 can not hold valve 17 its opened state, and thus this valve is closed and the preheating burner 20 is extinguished. Thereafter, the electromotive force-producing current of the thermo-couple 25 is rapidly decreased, but owing to the fact that the thermo-couple 24 is already by itself producing electromotive force-producing current sufficient to electrically maintain the safety valve 16 in the open condition, the catalytic combustion is continued.

It should be noted here that a needle pointer of the indicating meter 28 connected in parallel with the thermo-couples 26 and 27 is moved or deflected further towards the right side than in the combustion suspension period (FIG. 6), when the preheating burner 20 is caused to burn full and electromotive force is produced in the thermo-couple 27, while it is deflected to the leftmost position, when the preheating burner 20 is extinguished, i.e. when a sufficient electromotive force-producing current is produced in the thermo-couple 26, and thus, the state of catalytic combustion may be determined by the positions of the pointer needle of said indicating meter 28.

In the diagram of FIG. 9, the state of electromotive force-producing currents of thermo-couples 24 and 25 and the composite thereof is shown, while FIG. 10 illustrates the state of electromotive force-producing currents of thermo-couples 26 and 27 and a composite thereof.

As is clear from the foregoing description, according to the embodiment of the present invention as explained so far, since the preheating burner 20 continues to burn until the preheating of the catalytic mat 2 has been completed, the initiation of catalytic combustion can be more safely achieved with a very small amount of wasted fuel. Moreover, because only the preheating burner 20 continues to burn during the non-functioning period of the catalytic mat 2, any unusual state may be determined at a glance so as to prevent fuel from being discharged in advance. Furthermore, the starting of complete combustion by the catalytic mat 2 is indicated upon extinguishment of the preheating burner 20, and may be utilized for confirmation of catalytic combustion.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A catalytic combustion arrangement which comprises:

a catalytic mat layer having a catlytic mat which supports a catalyst;

a casing having said catalytic mat layer mounted therein;

means for supplying a fuel into said casing;

a safety valve in said fuel supplying means for controlling the flow of fuel and having an electromotive actuating means;

a preheating burner directed at said catalytic mat for heating said catalytic mat;

means connected to said preheating burner for feeding fuel to said preheating burner;

a control valve in said fuel feeding means for controlling the flow of fuel and having an electromotive actuating means;

a first set of thermo-couples, one of which is disposed adjacent to the edge of said catalytic mat and the other of which is disposed adjacent to said preheating burner, said thermo-couples in said first set being connected in series with each other in a direction for adding the electromotive force-producing currents produced therein by the heating and coupled with said actuating means of said safety valve for, when the amount of electromotive force-producing currents is sufficient, maintaining said safety valve open by electromotive force; and a second set of thermo-couples, one of which is disposed adjacent to the edge of said catalytic mat and the other of which is disposed adjacent to said preheating burner, said thermo-couples in said second set being connected in series with each other in a direction for cancelling the electromotive force-producing currents produced therein by the heating and coupled with said actuating means of said control valve for, when the amount of electromotive force-producing currents is sufficient, maintaining said control valve open only by electromotive force.

2. A catalytic combustion arrangement as claimed in claim 1, wherein said catalytic mat layer includes a heat resistant wire mesh, said catalytic mat which supports the catalyst, a heat insulation layer having at least two layers with different densities, and a supporting plate, all of which are stacked one upon another into one unit and accommodated in said casing.

3. A catalytic combustion arrangement as claimed in claim 1, wherein at least one of said sets of thermo-couples has an indicating means connected thereto for indicating by the flow of current therein the state of combustion in said mat.

* * * * *